US008434904B2

(12) United States Patent
Alvarez

(10) Patent No.: US 8,434,904 B2
(45) Date of Patent: May 7, 2013

(54) INSULATED GLASS UNITS INCORPORATING EMITTERS, AND/OR METHODS OF MAKING THE SAME

(75) Inventor: Jemssy Alvarez, Gregory, MI (US)

(73) Assignee: Guardian Industries Corp., Auburn Hills, MI (US)

( * ) Notice: Subject to any disclaimer, the term of this patent is extended or adjusted under 35 U.S.C. 154(b) by 304 days.

(21) Appl. No.: 12/926,713

(22) Filed: Dec. 6, 2010

(65) Prior Publication Data

US 2012/0140492 A1 Jun. 7, 2012

(51) Int. Cl.
*F21V 33/00* (2006.01)

(52) U.S. Cl.
USPC ..... 362/263; 362/265; 362/267; 362/249.02; 362/311.02

(58) Field of Classification Search ..... 362/267, 362/263, 265, 249.02, 311.02, 351
See application file for complete search history.

(56) References Cited

U.S. PATENT DOCUMENTS

| | | | | |
|---|---|---|---|---|
| 4,918,487 | A | 4/1990 | Coulter, Jr. | |
| 5,514,476 | A | 5/1996 | Hartig et al. | |
| 5,631,190 | A | 5/1997 | Negley | |
| 5,657,607 | A | 8/1997 | Collins et al. | |
| 5,664,395 | A | 9/1997 | Collins et al. | |
| 5,692,826 | A * | 12/1997 | Hsien-Jung | 362/190 |
| 5,693,962 | A | 12/1997 | Shi et al. | |
| 5,719,589 | A | 2/1998 | Norman et al. | |
| 5,784,853 | A | 7/1998 | Hood et al. | |
| 5,800,933 | A | 9/1998 | Hartig et al. | |
| 5,902,652 | A | 5/1999 | Collins et al. | |
| 5,912,477 | A | 6/1999 | Negley | |
| 6,014,872 | A | 1/2000 | Hartig et al. | |
| 6,632,491 | B1 | 10/2003 | Thomsen et al. | |
| 6,924,504 | B2 | 8/2005 | Humbs et al. | |
| 7,042,426 | B2 | 5/2006 | Shin | |
| 7,164,401 | B2 | 1/2007 | Kwon | |
| 7,224,334 | B2 | 5/2007 | Choi et al. | |
| 7,750,875 | B2 | 7/2010 | Kim et al. | |
| 2003/0230045 | A1 * | 12/2003 | Krause et al. | 52/786.13 |
| 2009/0151853 | A1 | 6/2009 | Cooper | |
| 2009/0151854 | A1 | 6/2009 | Cooper | |

(Continued)

FOREIGN PATENT DOCUMENTS

| | | |
|---|---|---|
| DE | 20 2008 014 993 | 2/2009 |
| DE | 10 2008 012 383 | 6/2009 |
| DE | 10 2008 052 806 | 4/2010 |
| EP | 1 267 029 | 12/2002 |

OTHER PUBLICATIONS

U.S. Appl. No. 12/923,146, filed Sep. 3, 2010; Broadway et al.
U.S. Appl. No. 12/659,352, filed Mar. 4, 2010; Veerasamy.

(Continued)

*Primary Examiner* — Laura Tso
(74) *Attorney, Agent, or Firm* — Nixon & Vanderhye P.C.

(57) ABSTRACT

Certain example embodiments relate to an improved IGU with first and second glass substrates, spaced apart and defining a gap therebetween. An edge seal is provided around a periphery of the first and second substrates, the edge seal forming an hermetic seal in certain example instances. An emitter is disposed in the gap defined by the first and second glass substrates. A conductive interface is provided through the edge seal, and is arranged to interface with the emitter and to provide electrical current to the emitter. The conductive interface in certain example embodiments may include one or more bus bars, one or more pattered thin film lines, etc.

12 Claims, 6 Drawing Sheets

U.S. PATENT DOCUMENTS

| | | | |
|---|---|---|---|
| 2009/0151855 | A1 | 6/2009 | Wang et al. |
| 2009/0155499 | A1 | 6/2009 | Cooper |
| 2009/0155500 | A1 | 6/2009 | Cooper et al. |
| 2009/0205956 | A1 | 8/2009 | Lu et al. |
| 2009/0214880 | A1 | 8/2009 | Lemmer |
| 2009/0324934 | A1 | 12/2009 | Blacker et al. |
| 2010/0075155 | A1 | 3/2010 | Veerasamy |
| 2010/0104840 | A1 | 4/2010 | Blacker et al. |

OTHER PUBLICATIONS

U.S. Appl. No. 12/654,269, filed Dec. 15, 2009; Veerasamy.
U.S. Appl. No. 12/801,257, filed May 28, 2010; Veerasamy.
U.S. Appl. No. 12/453,220, filed May 1, 2009; Wang.
U.S. Appl. No. 12/453,221, filed May 1, 2009; Wang.
"Light Guide Techniques Using LED Lamps", Application Brief I-003; Agilent Technologies, pp. 1-21.
U.S. Appl. No. 12/923,835, filed Oct. 8, 2010; Veerasamy et al.
U.S. Appl. No. 12/923,834, filed Oct. 8, 2010; Veerasamy et al.
U.S. Appl. No. 12/923,833, filed Oct. 8, 2010; Veerasamy et al.
U.S. Appl. No. 12/662,561, filed Apr. 22, 2010; Knoll et al.
U.S. Appl. No. 12/453,125, filed Apr. 29, 2009; Frank et al.
International Search Report dated Feb. 24, 2012.

* cited by examiner

INSULATED GLASS UNITS INCORPORATING EMITTERS, AND/OR METHODS OF MAKING THE SAME

FIELD OF THE INVENTION

Certain example embodiments of this invention relate to improved insulated glass units (IGUs), and/or methods of making the same. More particularly, certain example embodiments relate to techniques for disposing emitters (e.g., OLED, PLED, and other like emitters) within IGUs. Certain example embodiments provide techniques for connecting a drive voltage, power source, or the like, from a location external to the IGU to the emitters located within the IGU while maintaining a seal (e.g., an hermetic seal) around the periphery of the IGU.

BACKGROUND AND SUMMARY OF EXAMPLE EMBODIMENTS OF THE INVENTION

Windows serve aesthetic and functional purposes for both residential and commercial settings. For instance, windows may serve as passive light sources by allowing light from outside a structure to pass therein. Windows also help provide protection from the elements.

Conventional single pane windows, however, do not provide much of a barrier to the loss of heat. For example, the R-value (a measure of thermal resistance) of a single pane window may be approximately 1. In comparison, the R-value of a standard outside wall in the residential home may be 10 times that of the single paned window. Accordingly, single paned windows may provide some barrier, but it may not be a very effective barrier for preventing heat loss.

Insulting glass units are known in the art. See, for example, U.S. Pat. Nos. 6,632,491; 6,014,872; 5,800,933; 5,784,853; and 5,514,476, the entire contents of each of which are hereby incorporated herein by reference. Insulating glass units (IGUs) generally include two panes/sheets/substrates/lites of glass in substantially parallel spaced apart relation to one another, with an optionally gas filled pocket therebetween. The two substrates are sealed together through the use of seals around the edges of the two sheets. These edge seals may be hermetic seals, e.g., when the gap between the substrates is filled with a gas. Once sealed, the IGU is formed and may be installed (e.g., to replace a single paned window) in a commercial, residential, or other setting. In comparison to a single paned window, a standard double paned window may have an R-value more than 2. IG units may have yet higher R-values. Additional techniques may be used to yet further increase the R-value of a window (e.g., application of one or more low-e coatings, tinting of the glass, placing a vacuum or near vacuum between the two panes of glass, etc.).

Although windows and their ability to reduce heat loss have improved in recent years, the purpose of windows has largely remained unchanged. Namely, windows are used to provide a barrier (e.g., for heat loss), but at the same time allow people to look through and see other people, things, places, etc., that are on the other side of a window. Indeed, windows tend to merely serve as a generally transparent barrier. A person walking down a street lined with shops will likely be able to observe that most of the shops have windows filled with merchandise (or examples of merchandise)—e.g., window shopping. Similarly, in order to provide lighting to items on the outside or inside of a window, a corresponding lighting arrangement (e.g., a street lamp, a spot light to highlight items inside the window, etc.) may need to be installed.

Thus, conventional windows often are constructed, designed, and arranged to be looked through and not looked at.

One way to provide functionality beyond just being able to look through a glass window is to provide information or content on the window itself. For example, the owner of a shop could write on the outside or inside of the IGU. Unfortunately, however, simply writing on an outer surface of a window may not be aesthetically pleasing, and it oftentimes is not feasible to disassemble and reassemble an IGU. The inventor of the instant application has also realized that it would be desirable to turn a window into an active light source (e.g., at virtually any time of day) as opposed to an element through which light may pass (e.g., when light is shining from one side).

Thus, it will be appreciated that there is a need in art to increase the functionality and versatility of insulated glass units while maintaining the basic IGU functionality as a "barrier," e.g., to serve as a light source, vehicle for conveying information, and/or the lie. It will also be appreciated that there is a need in the art for improved IGUs, and/or methods of making the same.

In recent years, light emission technology has grown. For example, light-emitting diodes (LEDs) may be used for both lighting (e.g., as in light bulbs) and display purposes (e.g., in computer monitors and televisions). LED technology has further lead to developments in organic LEDs (or OLEDs). OLEDs may provide increased lighting capabilities and versatility over their inorganic counterparts.

FIG. 1 illustrates a conventional OLED device 100 disposed on a substrate 110. OLED device 100 includes a conductive layer 106 and an emissive layer 104. These two layers are disposed between an anode 108 and a cathode 102. The OLED device 100 functions when an electrical current, e.g., from an electrical source 112, flows from the cathode 102 to the anode 108 (or vice versa). The cathode 102 passes electrons to emissive layer 104, while anode 108 removes electrons from conductive layer 106. This difference in electrons between the two layers results in energy, in the form of a photon, being released. Accordingly, the released photon passes through the substrate 110 and may be observed in the outside world. One advantage to the OLED process is that the above related photon (and many others like it) can create a light source that is very similar to "natural" light, e.g., in terms of the optical wavelengths produced.

OLED devices may be thin. For example, an OLED display without an attached substrate may have a thickness between 100 to 500 nanometers. Thus, when viewing an OLED on its edge, the cross-sectional area of the OLED may be virtually undetectable to the naked human eye.

The inventor of the instant invention has discovered that it would be advantageous to incorporate emitters such as OLEDs, polymer light emitting diodes (PLEDs), and/or the like, into IGUs. The inventor of the instant invention has realized that in so doing it is possible to turn the window into an "active" light source with a coloration similar to natural light, and/or to provide potentially visually interesting information.

One aspect of certain example embodiments relates to integrating emitters such as, for example, OLEDs, PLEDs, and/or the like, into the airspace of an IGU so as to provide general "active" illumination in commercial, residential, or interior applications, as a door insert, a door side lite, etc., thereby potentially complementing or taking the place of other light sources.

Another aspect of certain example embodiments relates to building emitters into the IG window system, e.g., to enhance aesthetics and customer appeal, provide additional lighting capability for the inside or outside of a structure, serve as an integrated as part of a security or surveillance system, support advertising in commercial, residential, interior, door insert, or door sidelite applications, etc.

Still another aspect of certain example embodiments relates to techniques for providing an electrical connection between a drive voltage or power source outside an IGU to the emitters located within the IGU. In certain example embodiments, this may be accomplished using bus bars, thin films, and/or the like.

In certain example embodiments of this invention, an insulated glass unit is provided. First and second substantially parallel, spaced apart glass substrates are provided, with the first and second glass substrates defining a gap therebetween. An edge seal is provided around a periphery of the first and second substrates. An emitter is disposed in the gap. A conductive interface is formed in the edge seal, with the conductive interface supporting an electrical connection between the emitter and a power source located external to the insulated glass unit.

In certain example embodiments of this invention, a method of making an insulated glass unit is provided. The method comprises: providing a first glass substrate; providing a second glass substrate; orienting the first and second glass substrates in substantially parallel, spaced apart relation to one another and defining a gap therebetween; providing an edge seal around a periphery of the first and second substrates; and disposing an emitter, directly or indirectly, on the first and/or second substrate. A conductive interface is located in the edge seal, the conductive interface supporting an electrical connection between the emitter and a power source located external to the insulated glass unit.

According to certain example embodiments, third and fourth substantially parallel, spaced apart substrates may be provided, with the third and fourth substrates defining a second gap therebetween, The emitter may be disposed in the second gap, and the third and fourth substrates may be disposed in the gap between the first and second glass substrates.

According to certain example embodiments, the edge seal (s) between the first and second and/or third and fourth substrates may be hermetic.

According to certain example embodiments, the emitter may be disposed, directly or indirectly, on the first glass substrate without any intervening substrates therebetween.

At least one bus bar and/or at least one thin film line may be electrically connected to the emitter in certain example embodiments. A wire harness may be provided in the conductive interface of the edge seal, with the wire harness supporting a wire connected to the power source and to a lead connected to the emitter, and with the wire harness being at least partially filled so the edge seal is an hermetic seal.

The features, aspects, advantages, and example embodiments described herein may be combined in any suitable combination or sub-combination to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

Certain example embodiments relate to IGUs with integrated emitters placed within the IGU.

Figure 1:
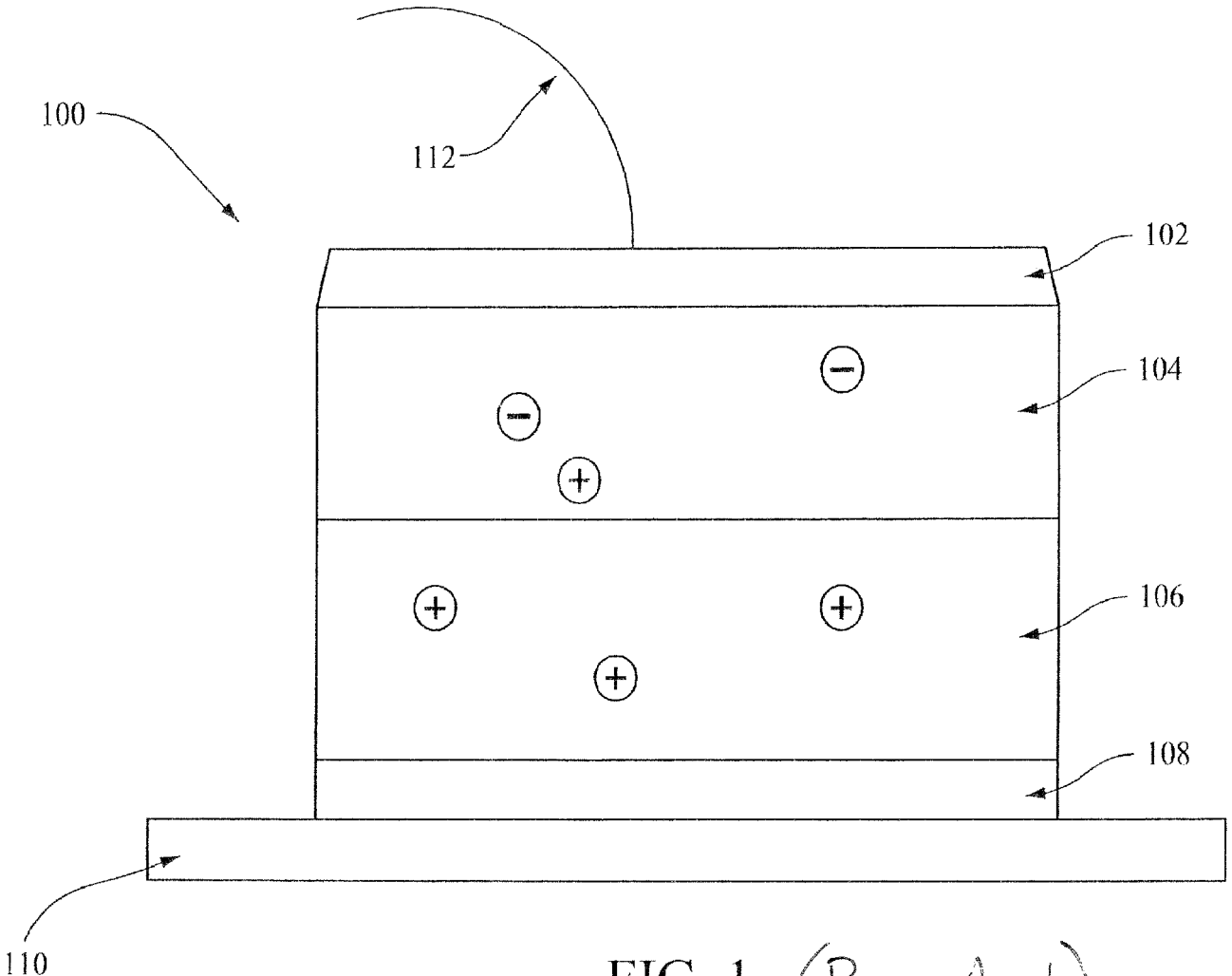
FIG. 1 (Prior Art)
FIG. 1 is a cross-sectional view of a conventional OLED device.
Figure 2B:
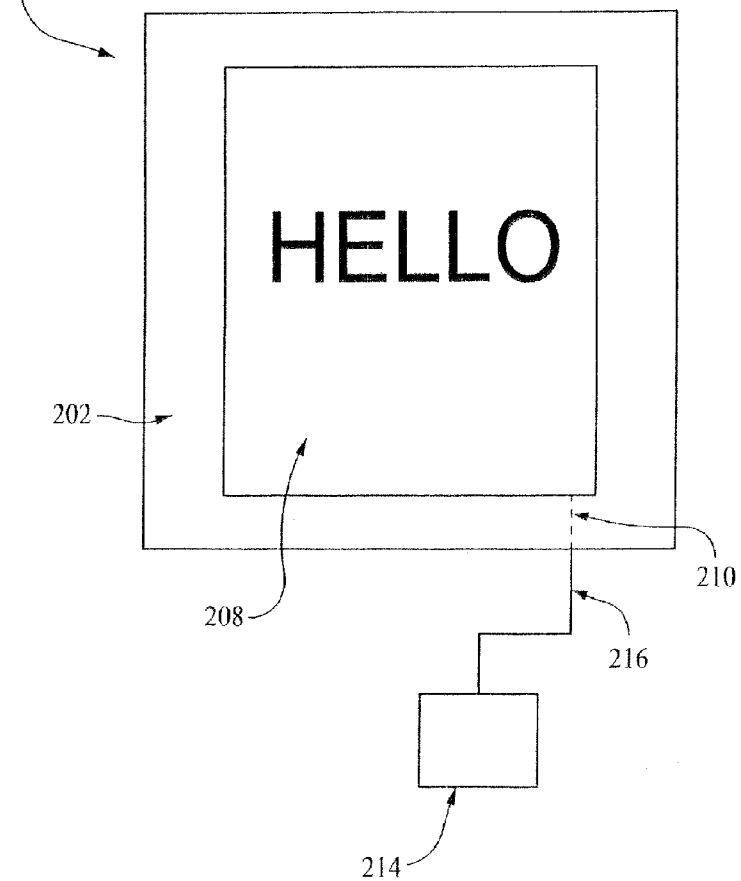
FIG. 2B is an illustrative plan view of the exemplary improved IGU with an sealed integrated emitter panel of FIG. 2A.
Figure 2A:
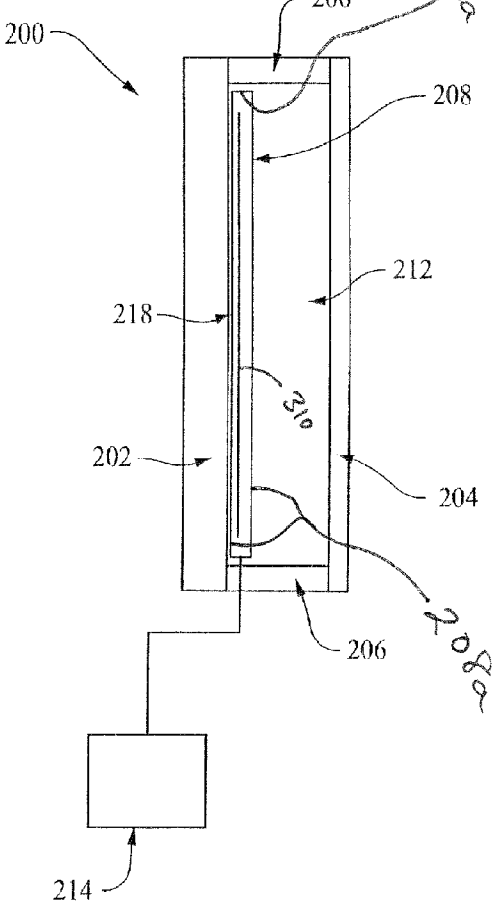
FIG. 2A is an illustrative cross-sectional view of an exemplary improved IGU with a sealed integrated emitter panel located therein in accordance with an example embodiment.

Referring now more particularly to the drawings in which like reference numerals indicate like parts throughout the several views, FIG. 2A is an illustrative cross-sectional view of an exemplary improved IGU with a sealed integrated emitter panel is shown. IGU 200 includes a first glass substrate 202 and a second glass substrate 204. It will be appreciated that certain example embodiments may incorporate more than 2 glass substrates (e.g., 3 glass substrates). Glass substrates 202 and 204 are held together by seals 206. A gap 212 may be defined by the combination of the glass substrates 202 and 204 and seals 206. Seals 206 may be constructed by any suitable method and may include any suitable material for providing a seal, e.g., for providing an hermetic seal, to the IGU. Materials for the seal 206 may include, for example, ceramic foam, metal, glass, frit, and/or other seals. As metals may be a conductor of heat, non-metal seals may be used and may help provide for higher R-values of the windows (e.g., as heat conductive spacer seals may provide a path of heat transfer around an insulating gas pocket). Non-hermitic seals also may be used in certain example embodiments. Increased R-values of IGU 200 may be achieved by substituting or supplementing standard atmospheric gas with higher viscosity gasses. Theses gasses may include, for example, inert gasses such as argon, krypton, xenon, or other gasses that may be non-toxic, clear, odorless, chemically inert, etc. In certain example instances, in addition to increasing the R-value of an IGU, sealing gas into an IGU may facilitate the removal of condensation and humidity. Both condensation and humidity may adversity affect the appearance of the IGU and may affect the life expectancy and performance of the emitter within the IGU (e.g., OLEDs).

Other techniques of increasing the R-value of the IGU may be employed in certain example embodiments. For instance, certain example embodiments may use tinted glass as part of the IGU. Tinted glass may reduce heat gained from solar radiation hitting the outside of the glass. Further, the IGU may use various coatings to reduce solar radiation passing through the glass. Low-emissivity coatings may also be used. Low-E coatings may be used, for example, to reflect or reduce thermal radiation (e.g., the heat transfer through the IGU is lower, thus increasing the R-value). A silver-based low-E coating suitable for certain example embodiments of this invention may be any one of the low-E coatings described in U.S. Publication Nos. 2009/0214880; 2009/0205956; 2010/

0075155; and 2010/0104840, as well as U.S. application Ser. No. 12/662,561, the entire contents of which are hereby incorporated herein by reference. Example low-E coatings having split silver layers are described in, for example, U.S. application Ser. No. 12/453,125, as well as U.S. Publication No. 2009/0324934, the entire contents of each of which are hereby incorporated herein by reference.

An hermetically sealed emitter panel 208 may be located in the gap 212. Emitter panel 208 may include an OLED display 218. The OLED display 218 may be either an active matrix or a passive matrix OLED device. See, for example, U.S. Pat. Nos. 7,750,875; 7,224,334; 7,164,401; 7,042,426; 6,924,504; 5,719,589; and 5,693,962, each of which is hereby incorporated by reference in its entirety. It will be appreciated that other types of emitters may be used, such as, for example, LEDs, PLEDs, etc. OLED display 218 included in emitter panel 208 may be substantially transparent when in the off state. Thus, in certain example embodiments, in the off state, the entire assembly may have a visible transmission of at least about 50%, more preferably at least about 60%, and sometimes even 70%, depending on the application. For example, in certain privacy or storefront applications, lower transmission may be acceptable and/or even desirable. The overall transparency of the IGU may only be slightly reduced when compared to not having the emitter panel 208 present within IGU 200.

The above technique may facilitate modularization of the manufacturing process of the IGU 200. The emitter panel 208 may be a smaller IGU containing an emitter that may then be placed within IGU 200. Accordingly, emitter panel 208 may be manufactured separately from IGU 200 and then plugged in during the manufacturing of IGU 200. Emitter panel 208 may also be retrofitted in existing IGUs.

The above sub-panel technique may also allow different gasses to be placed in the emitter panel 208 and the gap 212. OLEDs may suffer from decreased performance and/or life span when brought into contact with oxygen and/or moisture. Thus, the emitter panel 208 may provide added protection for OLED 218 contained therein (e.g., in case of a leak or if the gap 212 includes oxygen). For example, argon may be used to fill emitter panel 208, and ordinary atmosphere may be used to fill the gap 212 of the IGU 200. Getter materials also may be placed in or around the outer and/or inner IGUs. Thus, the emitter panel 208 may include third and fourth substantially parallel spaced apart substrates 208*a*, with the third and fourth substrates 208*a* defining a second gap therebetween in which the emitted 310 is provided. The edge seal(s) (206 and/or 206*a*) between the first and second and/or third and fourth substrates may be hermetic.

The emitters may be arranged so as to provide lighting throughout all, substantially all, or a portion of the window. Alternative, or in addition, the emitters may be arranged or programmed to provide a custom textual and/or graphic display. FIG. 2B is an illustrative plan view of the exemplary improved IGU with the sealed integrated emitter panel of FIG. 2A. The FIG. 2B example IGU 200 and emitter panel 208 is programmed to display "HELLO." This message is displayed by OLED 218 within emitter panel 208 (note that the visible lines of emitter panel 208 in FIG. 2B are for illustrative purposes and may or may not be visible). As shown in FIG. 2B, a conductive interface 210 is placed onto glass substrate 202 to facilitate control of, and provide electrical current to, the OLEDs from outside of IGU 200. In operation, conductive interface 210 may be attached to wire 216. Wire 216 may be provided through the seal 206. It will be appreciated that although the wire 216 goes through seal 206, in certain example embodiments, the hermetic seal surrounding gap 212 remains intact. Once wire 216 is accessible from outside of IGU 200, it may interface with electrical system 214. Electrical system 214 may include drive electronics for controlling OLED 218.

As will be discussed below, the OLED emitters may be programmable and structured to allow different messages and/or functionality to be used depending on the needs of a user. Thus, it will be appreciated that the "HELLO" message in the FIG. 2B example is provided by way of example. Other textual and/or graphic messages may be programmed or reprogrammed for display by the improved IGU.

The conductive interface 210 may be a standard copper wire or other means of providing electrical current into the gap 212. It will be appreciated that while a standard copper wire may be used, other less visible techniques may also be employed to provide electrical current to emitter panel 208. One technique of accomplishing this may be to provide a bus bar from the emitter panel 208 to seal 206. This may be accomplished by placing a narrow line of conductive material, for example, silver, onto the glass substrate 202. The line may be small enough to be difficult or impossible to the bare human eye and thus (because the line is relatively difficult to discern) may be more aesthetically pleasing to individuals looking through the window. Alternatively, the connection may be concealed by the frame of the IGU, by black or other colored frit material (e.g., later screen printed on one or more of the substrates in the overall unit 200), or by other suitable means.

An alternative technique may use a transparent conductive oxide (TCO) such as, for example, indium tin oxide (ITO), fluorine doped tin oxide (FTO), doped or undoped zinc oxide, etc., to create a conductive interface to provide electrical power to emitter panel 208. For instance, a physical vapor deposition process such as sputter may be used if a mask is disposed on the glass substrate 202, the TCO is disposed onto the glass substrate, and the mask is then removed. Alternatively, or in addition, the TCO may be deposited and the excess TCO removed, e.g., by a suitable etchant, photolithography, laser patterning, etc. These techniques may be carried out during the manufacturing process of IGU 200 (e.g., before sealing). Alternatively, or in addition, other connection techniques may be carried out after IGU 200 has been sealed. Thus, conductive interface 210 may facilitate the transfer of electrical current to emitter panel 208.

Figure 5:
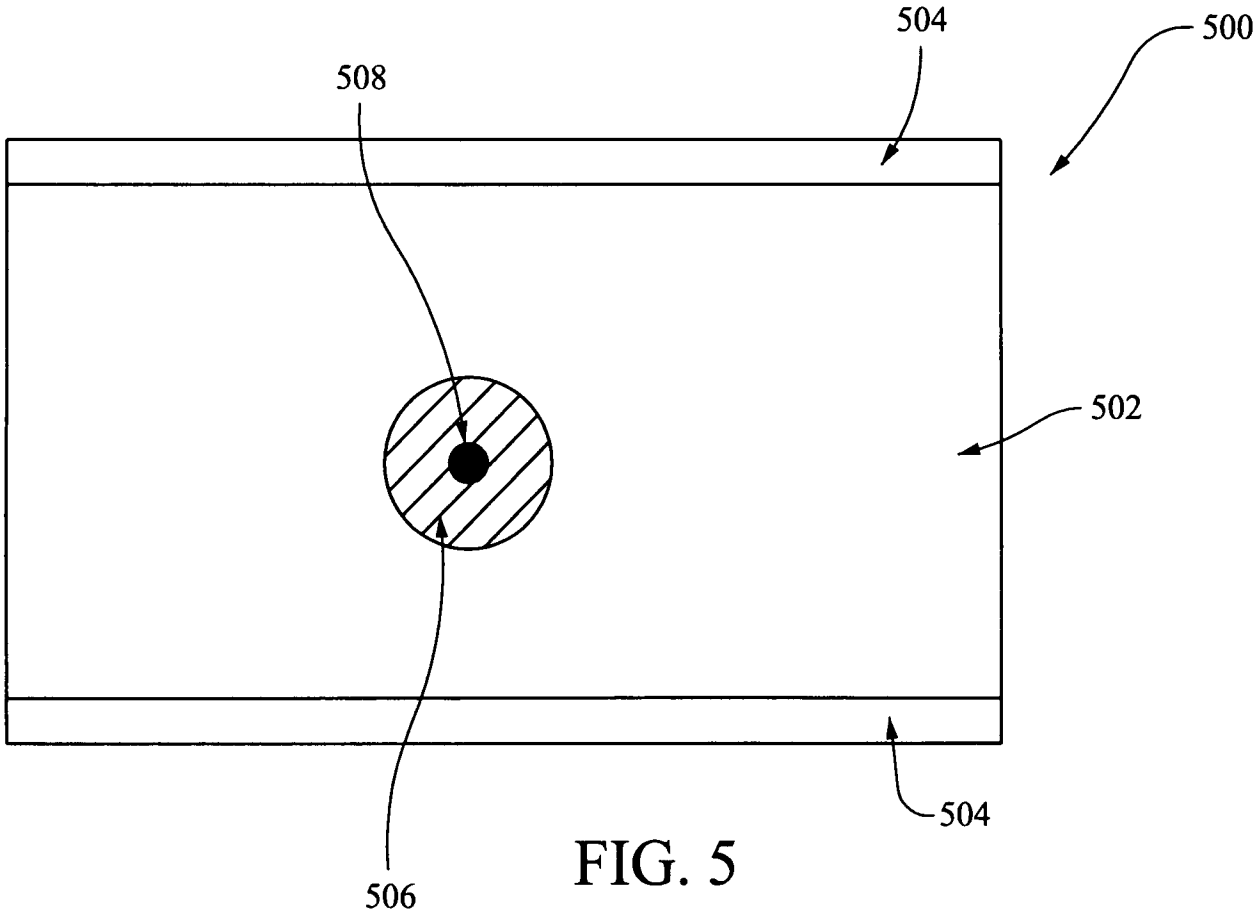
FIG. 5 is an illustrative elevation view of an exemplary improved IGU with access to electrical current in accordance with an example embodiment.

During (or after) the manufacturing of an IGU, a wire may be placed through the seal of the IGU to provide power to the interior of the IGU. FIG. 5 is an illustrative elevation view of an exemplary improved IGU with access to electrical current in accordance with an example embodiment is shown. IGU 500 may include glass substrates 504 and spacer seal 502. To provide access to the interior portion of IGU 500, a hole 506 may be drilled through or otherwise formed in spacer seal 502. This kind of hole may be thought of as a conductive interface, e.g., from an external power source to the interior of the IGU and a lead (e.g., bus bar or thin film line) located therein. Once formed, the wire 508 may be fed through the hole 506 and connected to interior element(s) of IGU 500 (e.g., a bus bar, a patterned thin film line, or the like). After feeding the wire 508 through the hole 506, the remainder of hole 506 may be filled with a lower water vapor transmission resin or the like. When resins are used, following the filling of the hole, the resin may be cured. The curing process then reseals IGU 500, possibly hermetically in certain example embodiments.

It will be appreciated that other techniques for providing a hole through spacer seal 502 may be used, such as, for example, piercing the seal with a laser. In alternative embodiments, the wire provided through the seal may be constructed as part of the seal when the seal is initially constructed.

Figure 6:
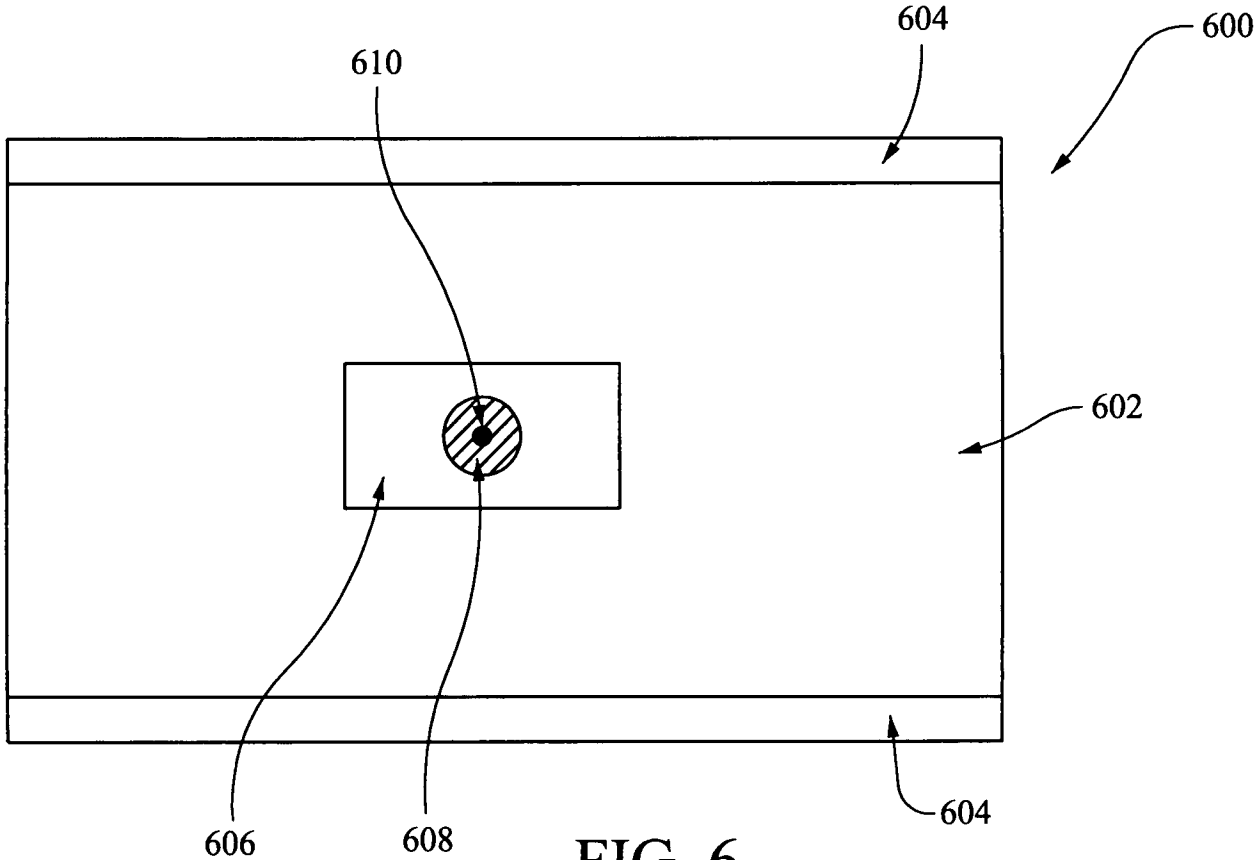
FIG. 6 is an illustrative elevation view of a wire harness attached to an exemplary improved IGU according to an example embodiment.

FIG. 6 is an illustrative elevation view of a wire harness attached to an exemplary improved IGU according to an example embodiment. IGU 600 is provided and may include glass substrates 604 and a spacer seal 602 located therebetween. A hole (not shown) is created in the spacer seal 602 and the wire harness 606 is placed on top of the hole. Wire harness 606 may be block, spherical, or otherwise shaped and/or formed, e.g., prior to installation. Wire harness 606 may include the hole 608. A wire 610 is provided through the hole 608 and fed through the hole created through the spacer seal 602. Once the wire 610 is placed through the hole 608 in the wire harness 606, the remainder of hole 608 may be filled, e.g., with a lower water vapor transmission resin or the like. Once the hole 608 is filled, the resin may be cured. The curing process then reseals the hole in wire harness 606. Once the wire 610 is placed into the hole created through the spacer seal 602, the wire harness 606 may be secured, e.g., over, and/or in, the hole created through spacer seal 602. The wire harness may be secured to the spacer seal 602 by any suitable technique such as, for example, using polyisobutylene and mechanical fasteners (e.g., braces) to affix the wire harness and establish a hermitic seal.

It will be appreciated that the example arrangements shown in FIG. 5 and FIG. 6 may be used in connection with an inner panel (e.g., 208 in FIG. 2) and/or the outer panel. Furthermore, the use of bus bars and thin films may be used in any suitable combination or sub-combination.

Figure 3B:
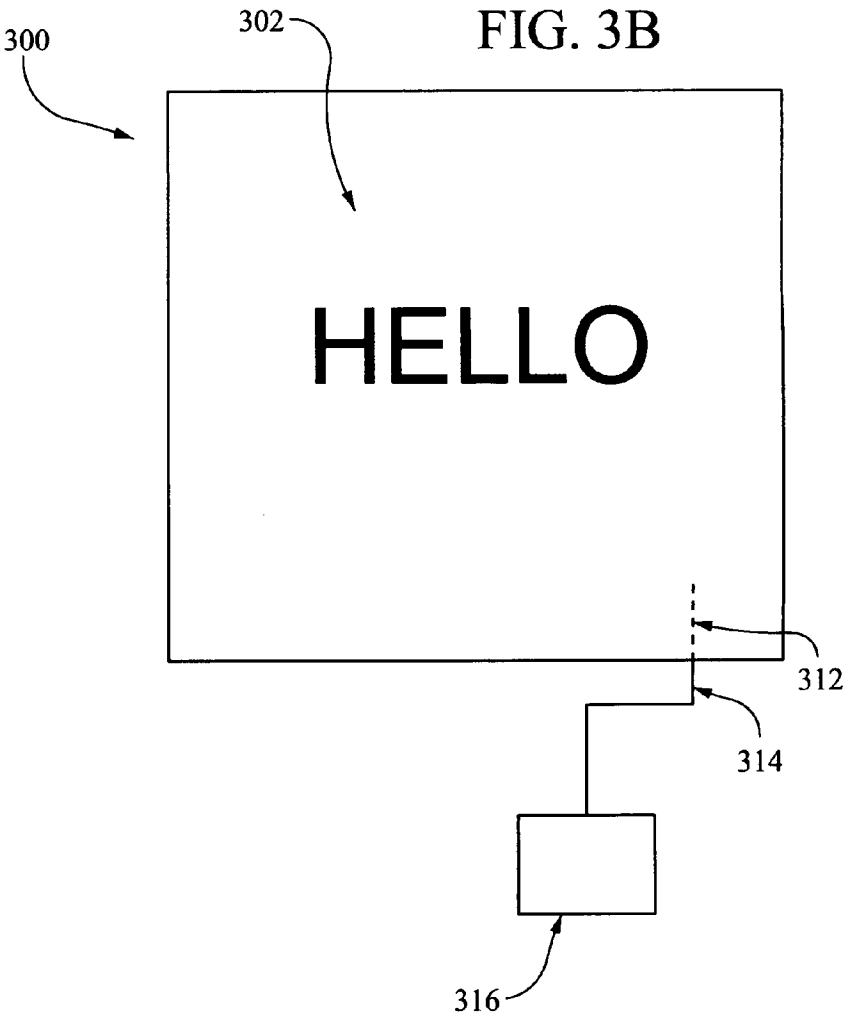
FIG. 3B is an illustrative plan view of the exemplary improved IGU with an integrated emitter of FIG. 3A.
Figure 3A:
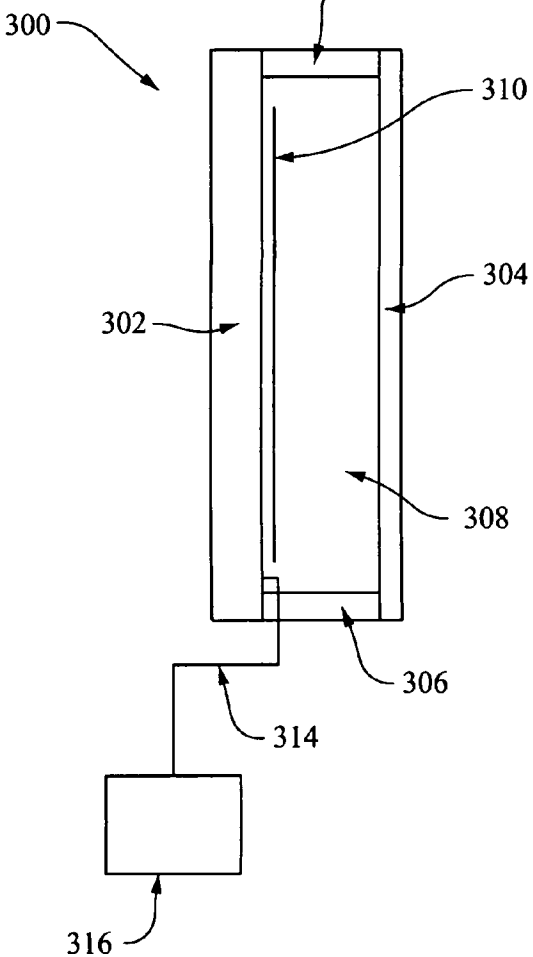
FIG. 3A is an illustrative cross-sectional view of exemplary improved IGU with an integrated emitter disposed on a substrate of the IGU in accordance with an example embodiment.

FIG. 3A is an illustrative cross-sectional view of an exemplary improved IGU with an integrated emitter. IGU 300 includes glass substrates 302 and 304. Substrates 302 and 304 are provided and form a gap 308 optionally filed with a gas when sealed with spacer seals 306. An emitter 310 may be disposed on the inside of glass substrate 302 (note that the line representing emitter 310 may or may not be visible and is for illustrative purposes). Similar to above, the emitter 310 may be any suitable type or types of emitter(s) (e.g., OLED, PLED, etc.). Also as explained above, various types of gas may be used (e.g., argon, krypton, xenon, and/or the like).

FIG. 3B is an illustrative plan view of the exemplary improved IGU with the integrated emitter of FIG. 3A. Emitter 310 is shown displaying a text-inclusive message ("Hello"). A conductive interface 312 may facilitate the transfer of electrical current from wire 314 to emitter 310. A wire 314 may be provided with electrical current from the power source 316. The wire 314 may be provided through the seal 306, e.g., using the example techniques discussed in detail above.

It will be appreciated that there may be various ways to provide electrical current, such as, for example, a battery array used in combination with a photovoltaic array, standard AC current from a wall socket, etc. Furthermore, as discussed above, power source 316 may also include drive electronics to more precisely control the emitter 310 beyond simply turning the whole emitter on or off. The drive electronics may facilitate greater programmability of emitter 310. Such programmability may allow a user to attach a device (e.g., a computer) to the window and program a particular display, e.g., of or including text, graphics, animations, live programming (e.g., television, closed circuit TV, etc.).

For example, in one embodiment an OLED may be disposed within an IGU and a programmable interface may be provided. The OLED may be programmed to provide enhanced aesthetics of the windows (e.g., by subtly outlining the window or creating any other desired/programmed image).

In certain example embodiments, an IGU with an OLED installed therein may be used as a part of a security system. A sensor may be provided that turns on the light in response to movement or the like. Further, the improved IGU may be integrated into a larger security system.

In another example embodiment an improved IGU may be used to provide extra light. As explained above, OLEDs may mimic natural light. Accordingly, a light sensor may be added to interface with an OLED. During the daytime when light is streaming through the window, the OLED may be turned off. However, at night or in periods of reduced sunshine, etc., the OLED may be turned on to provide "natural" light even though it is dark outside. This may be done through a timer, for example, turning on the OLED at a certain time or the above light sensor may be used. Further, the amount of light output by the OLED through the IGU may be inversely proportional to the amount of light proceeding through the window. This progressive ramp up may then allow for a more gradual change in operation by the improved IGU and the OLED contained therein.

In certain example embodiments, an improved IGU may be used in advertising. For instance, certain example embodiments may be used as a part of, or as, as a store window display. The OLED contained therein may be programmed to provide a variety of commercials or views to passing patrons. Further configurations may include automatically varying the type items displayed by the OLED based on the time of day. For example, in the morning at a café, items relating to breakfast may be displayed. In the afternoon, the lunch menu or "today's specials" may be displayed. Similarly, during the evening, the dinner menu may be displayed.

In yet another example embodiment, a skylight may be improved by the installation of an improved IGU with an OLED contained therein. In such an embodiment, programmable logic may be implemented that allows the OLED to mimic a night sky. The OLED could thus mimic the display of stars, planets, the moon, and/or other celestial bodies. Alternative, or in addition, OLEDs in skylights and/or the like may be turned on like normal lights (e.g., with switches, upon detection of darkness, etc.), to provide a source of overhead lighting. Of course, windows including OLEDs also may be thought of as wall-mounted light sources.

As discussed above with respect to certain example embodiments, a programmable emitter may be provided within an IGU. Facilitating precise control over an OLED matrix (or other type of emitter) may be accomplished by integrating a thin film transistor (TFT) array into the OLED. Accordingly, by providing an electrical current to the TFT array, precise control over individual pixels of an emitter may be achieved.

Figure 4:
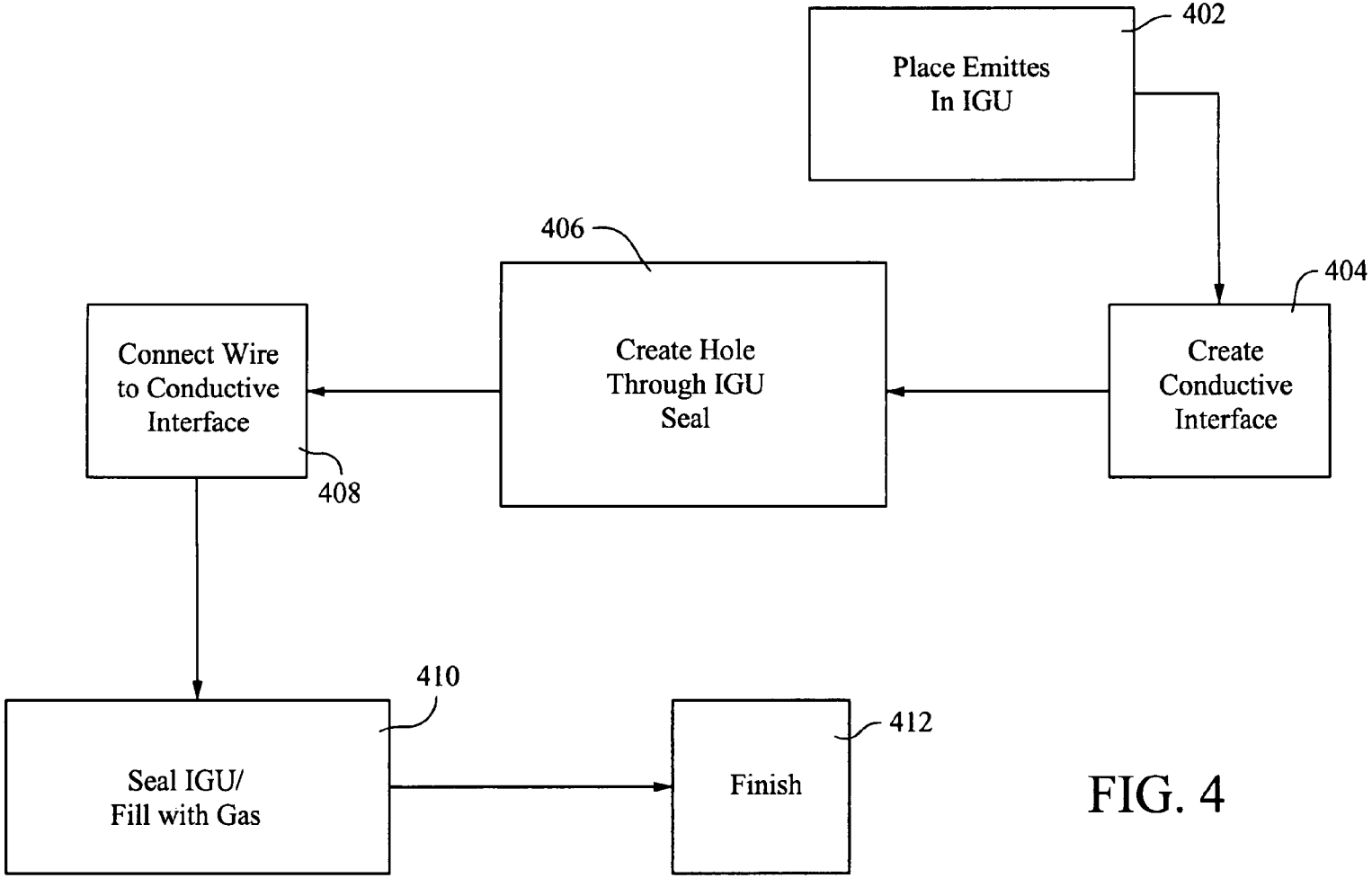
FIG. 4 is a flowchart of an illustrative method for constructing an improved IGU according to an example embodiment.

FIG. 4 is a flowchart of an illustrative method for constructing an improved IGU according to an example embodiment. In step 402 an emitter is placed in an IGU. As discussed above, this may be accomplished by providing a previously sealed, integrated emitter panel or an emitter on one of the substrates of the IGU. Once emitter is positioned, in step 404, the conductive interface is created. This may involve, for example, providing conductive bus bars, forming a thin film line, and/o the like. In step 406, the seal to the IGU is pierced, and a wire is run through the created hole. The wire is then connected to the conductive interface in step 408. This may be accomplished, for example, by a solder connection, electrical touch contact connection, etc., before or after the IGU is sealed in step 410. Step 410 involves sealing the IGU with a spacer seal and optionally filling the gap between the substrates with a gas (e.g., argon). In step 412, the process is completed (e.g., the IGU may be built into a frame, etc.) and the improved IGU is ready for use (e.g., to be installed and hooked up to a power source).

It will be appreciated that the steps may be performed in various orders (e.g., the seal may be pierced before or after a conductive interface is placed).

It will be appreciated that the substrates of the outermost IGU may be the same or differently sized. Similarly, when a smaller inner IGU is provided for the emitter, the substrates thereof may be the same or differently sized.

Although certain example embodiments have been described as relating to LED, OLED, and PLED emitters, other types of emitters may be used in connection with different embodiments of this invention.

"Peripheral" and "edge" seals herein do not mean that the seals are located at the absolute periphery or edge of the unit, but instead mean that the seal is at least partially located at or near (e.g., within about two inches of) an edge of at least one substrate of the unit. Likewise, "edge" as used herein is not limited to the absolute edge of a glass substrate but also may include an area at or near (e.g., within about two inches of) an absolute edge of the substrate(s).

As used herein, the terms "on," "supported by," and the like should not be interpreted to mean that two elements are directly adjacent to one another unless explicitly stated. In other words, a first layer may be said to be "on" or "supported by" a second layer, even if there are one or more layers therebetween.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An insulated glass unit, comprising:

first and second substantially parallel, spaced apart glass substrates, the first and second glass substrates defining a gap therebetween;

an edge seal provided around a periphery of the first and second substrates;

an emitter disposed in the gap;

a conductive interface formed in the edge seal, the conductive interface supporting an electrical connection between the emitter and a power source located external to the insulated glass unit; and wherein the edge seal is a hermetic seal and wherein the gap includes argon, krypton, and/or xenon gas.

2. The insulated glass unit of claim 1, wherein the edge seal is an hermetic seal and wherein the emitter is disposed, directly or indirectly, on the first glass substrate without any intervening substrates therebetween.

3. The insulated glass unit of claim 1, wherein the emitter is an organic light emitting diode.

4. The insulated glass unit of claim 1, further comprising a wire harness provided in the conductive interface of the edge seal, the wire harness supporting a wire connected to the power source and to a lead connected to the emitter.

5. The insulated glass unit of claim 1, wherein the insulated glass unit is a window for a building.

6. An insulated glass unit, comprising:

first and second substantially parallel, spaced apart glass substrates, the first and second glass substrates defining a first gap therebetween;

an edge seal provided around a periphery of the first and second substrates;

an emitter;

a conductive interface formed in the edge seal, the conductive interface supporting an electrical connection between the emitter and a power source located external to the insulated glass unit;

third and fourth substantially parallel, spaced apart substrates, the third and fourth substrates defining a second gap therebetween, wherein the emitter is disposed in the second gap, and wherein the third and fourth substrates are disposed in the first gap between the first and second glass substrates.

7. The insulated glass unit of claim 6, further comprising a second edge seal hermetically sealing together the third and fourth substrates.

8. The insulated glass unit of claim 7, wherein the first gap includes a first type of gas and the second gap includes a second type of gas.

9. The insulated glass unit of claim 6, wherein an edge seal between the third and fourth substrates is an hermetic seal and wherein the first gap includes argon, krypton, and/or xenon gas.

10. The insulated glass unit of claim 6, wherein the insulated glass unit is a window for a building.

11. A method of making an insulated glass unit, the method comprising:

providing a first glass substrate;

providing a second glass substrate;

orienting the first and second glass substrates in substantially parallel, spaced apart relation to one another and defining a gap therebetween;

providing an edge seal around a periphery of the first and second substrates;

disposing an emitter, directly or indirectly, on the first and/or second substrate, wherein a conductive interface is located in the edge seal, the conductive interface supporting an electrical connection between the emitter and a power source located external to the insulated glass unit, wherein the emitter is sandwiched between third and fourth substantially parallel, spaced apart substrates, the third and fourth substrates defining a second gap therebetween, and wherein the third and fourth substrates are disposed in the gap between the first and second glass substrates.

12. The method of claim 11, further comprising providing a wire harness in the conductive interface of the edge seal, the wire harness supporting a wire connected to the power source and to a lead connected to the emitter, the wire harness being at least partially filled so the edge seal is an hermetic seal.

* * * * *